US009037389B2

(12) United States Patent
You

(10) Patent No.: US 9,037,389 B2
(45) Date of Patent: May 19, 2015

(54) VEHICLE APPARATUS AND SYSTEM FOR CONTROLLING PLATOON TRAVEL AND METHOD FOR SELECTING LEAD VEHICLE

(71) Applicant: Hyundai Motor Company, Seoul (KR)

(72) Inventor: Byung Yong You, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 32 days.

(21) Appl. No.: 13/964,314

(22) Filed: Aug. 12, 2013

(65) Prior Publication Data

US 2014/0244144 A1 Aug. 28, 2014

(30) Foreign Application Priority Data

Feb. 26, 2013 (KR) ..... 10-2013-0020461

(51) Int. Cl.
*G08G 1/00* (2006.01)

(52) U.S. Cl.
CPC ..... *G08G 1/22* (2013.01)

(58) Field of Classification Search
CPC ..... G08G 1/22
USPC ..... 701/117, 21, 24
See application file for complete search history.

(56) References Cited

U.S. PATENT DOCUMENTS

| | | | | |
|---|---|---|---|---|
| 8,352,111 | B2 * | 1/2013 | Mudalige | 701/24 |
| 2010/0256835 | A1 * | 10/2010 | Mudalige | 701/2 |
| 2010/0256852 | A1 * | 10/2010 | Mudalige | 701/24 |

FOREIGN PATENT DOCUMENTS

| | | | |
|---|---|---|---|
| JP | 2000331296 | A | 11/2000 |
| JP | 2001246962 | A | 9/2001 |
| JP | 2009-229294 | | 10/2009 |
| JP | 2009-229417 | | 10/2009 |
| KR | 10-1999-0061934 | | 7/1999 |
| KR | 10-2004-0000947 | | 1/2004 |
| KR | 10-0957137 | | 5/2010 |
| KR | 10-2010-0083024 | | 7/2010 |

OTHER PUBLICATIONS

Notice of Allowance issued Jan. 23, 2015, in corresponding to Korean Application No. 9-5-2015-005434503.

* cited by examiner

*Primary Examiner* — Mary Cheung
*Assistant Examiner* — Michael Berns
(74) *Attorney, Agent, or Firm* — Mintz Levin Cohn Ferris Glovsky and Popeo, P.C.; Peter F. Corless

(57) ABSTRACT

A vehicle apparatus, a platoon travel control system and a method for selecting a lead vehicle using the vehicle apparatus and the platoon travel control system. Specifically, charges for platoon travel of surrounding vehicles is calculated based on input charge calculation conditions and the calculated charges are output by matching the conditions with images of surrounding vehicles. Additionally, a vehicle selected by the user is designated as a lead vehicle, thereby performing a platoon travel procedure.

14 Claims, 10 Drawing Sheets

VEHICLE APPARATUS AND SYSTEM FOR CONTROLLING PLATOON TRAVEL AND METHOD FOR SELECTING LEAD VEHICLE

CROSS-REFERENCE TO RELATED APPLICATION

This application is based on and claims priority from Korean Patent Application No.10-2013-0020461, filed on Feb. 26, 2013 in the Korean Intellectual Property Office, the disclosure of which is incorporated herein in its entirety by reference.

BACKGROUND

1. Field of the Invention

The present invention relates to a vehicle apparatus, a platoon travel control system, and a method for selecting a lead vehicle using the vehicle apparatus and platoon travel control system.

2. Description of the Prior Art

Currently, technologies for traveling in a platoon have been developing and trial runs are being conducted on actual roads, led by the motor industry. In the related art, vehicles travel in a platoon that keep a minimal safety distance therebetween, of which only a lead vehicle needs be driven by a driver and the following vehicles do not. Even though research on platoon travel technology has been conducted, a service to which those technologies are practically applicable has not specified.

SUMMARY

Accordingly, the present invention provides a vehicle apparatus and a platoon travel (e.g., carpool) control system that select a lead vehicle based on criteria set by a user, and a method for selecting a lead vehicle using the vehicle apparatus and the platoon travel control system.

In one aspect of the present invention a vehicle apparatus may include: a surrounding vehicle information receiving unit configured to receive images of surrounding vehicles and information on the surrounding vehicles transmitted from a platoon travel control system; a charge calculating unit configured to calculate charges for platoon travel of the surrounding vehicles based on charge calculation conditions input via an input unit by a user, or is configured to receive charges for platoon travel of the surrounding vehicles transmitted from the platoon travel control system; a surrounding vehicle information providing unit configured to output via an output unit the charges for platoon travel of the surrounding vehicles transmitted from the charge calculating unit by matching with the images of the surrounding vehicles; and a processing unit configured to execute a platoon travel procedure by designating a vehicle selected by the user from among the surrounding vehicles matched with the charges for platoon travel as a lead vehicle.

When the vehicle apparatus calculates the charges for platoon travel, the charge calculating unit may further include: a charge estimation criteria setting unit configured to receive and manage the charge estimation conditions input by a user; and a charge estimation unit configured to calculate the charges for the platoon travel of the surrounding vehicle using the information on the surrounding vehicle and the charge estimation conditions.

When the vehicle apparatus receives the charges for platoon travel from the platoon travel control system, the charge calculating unit may include: a charge calculation criteria setting unit configured to transmit charge calculation conditions input by the user to the platoon travel control system; and a charge calculation unit configured to receive the charges for platoon travel of the surrounding vehicle transmitted from the platoon travel control system.

The charge calculation conditions may include one or more of a group selected from: a departure point, a destination, a stopover point, a minimum number of vehicles in platoon travel, a maximum number of vehicles in platoon travel, a travel time, a driving experience, an accident rate, a driver's age, driver's gender, a vehicle model, an engine displacement, a model year, charge designated by a lead vehicle, and recommendation points.

In another aspect of the present invention, a platoon travel control system may include: a charge calculation criteria setting unit configured to receive charge calculation conditions input by a user or transmitted from a vehicle apparatus to manage the charge calculation conditions by matching with identification information of the vehicle apparatus; a vehicle information receiving unit configured to receive information to calculate charges from a plurality of vehicle apparatuses and receive an image of the vehicle matched with the identification of the vehicle apparatus from a plurality of imaging devices; a charge calculating unit configured to calculate charges for platoon travel for surrounding vehicles based on predetermined charge calculation conditions of a vehicle of which the charges for platoon travel have been requested; and a vehicle information providing unit configured to transmit the charges for platoon travel of the surrounding vehicles and the images of the surrounding vehicles with respect to the vehicle apparatus of which the charges for the platoon travel have been requested to the vehicle apparatus which has requested the charges for the platoon travel by matching with the identification information of the vehicle apparatus.

The charge calculation conditions may include one or more or more of a group selected from: a departure point, a destination, a stopover point, a minimum number of vehicles in platoon travel, a maximum number of vehicles in platoon travel, a travel time, a driving experience, an accident rate, a driver's age, driver's gender, a vehicle model, an engine displacement, a model year, charge designated by a lead vehicle, and recommendation points.

In another aspect of the present invention a method for selecting a lead vehicle may include: receiving charge calculation conditions via an input unit input by a vehicle apparatus; receiving images of surrounding vehicles and information on the surrounding vehicles matched with identification information of the vehicle apparatus transmitted from a platoon travel control system; calculating charges for platoon travel of the surrounding vehicle based on the charge calculation condition and the information on the surrounding vehicles; outputting the charges for platoon travel of the surrounding vehicles via an output unit by matching the images of the surrounding vehicles; and designating a vehicle selected by a user from among the surrounding vehicles matched with the charges for platoon travel as a lead vehicle.

The charge calculation conditions may include one or more of a group selected from: a departure point, a destination, a stopover point, a minimum number of vehicles in platoon travel, a maximum number of vehicles in platoon travel, a travel time, a driving experience, an accident rate, a driver's age, driver's gender, a vehicle model, an engine displacement, a model year, charge designated by a lead vehicle, and recommendation points.

The outputting of the charges may include outputting the images of the surrounding vehicles based on the identification information matched with the charges for platoon travel of the surrounding vehicles.

In another aspect of the present invention, a method for selecting a lead vehicle may include: receiving, by a platoon travel control system, charge calculation conditions input by a user or transmitted from a vehicle apparatus and storing the charge calculation conditions by matching with identification information of the vehicle apparatus; collecting information to calculate charges transmitted from a plurality of vehicles and images of the vehicles matched with identification information of the vehicle transmitted from a plurality of imaging devices; calculating charges for platoon travel of surrounding vehicles based on predetermined charge calculation conditions of a vehicle apparatus of which charges for platoon travel has been requested; and transmitting charges for platoon travel of the surrounding vehicles and images of the surrounding vehicles with respect to the vehicle apparatus of which charges for platoon travel has been requested by matching with identification information of the vehicle to a vehicle which has requested charges for platoon travel.

Various features and advantages of the present invention will be more obvious from the following description with reference to the accompanying drawings.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION

Figure 1:
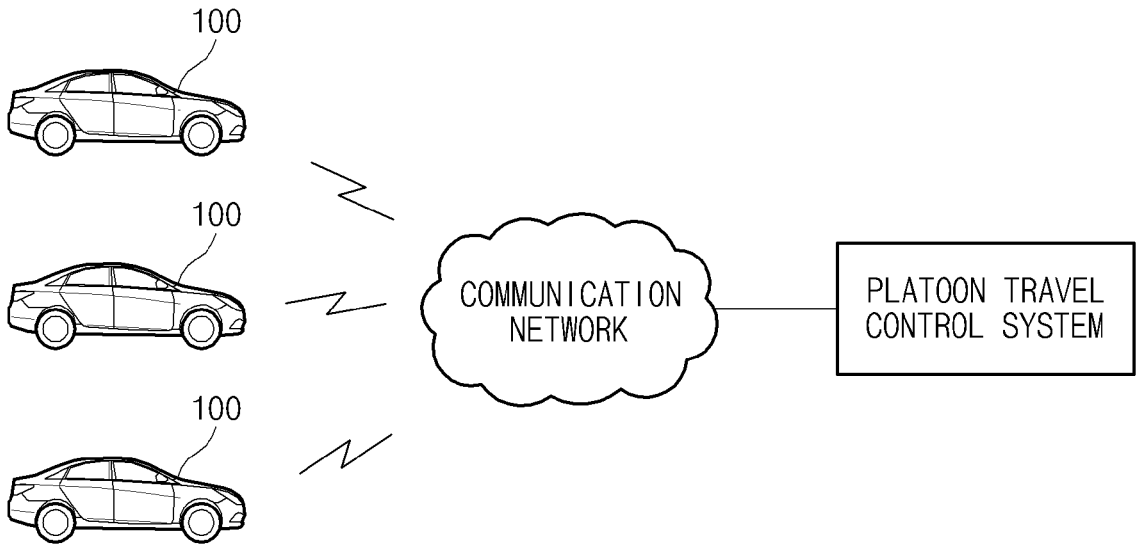
FIG. 1 is an exemplary diagram illustrating a connection relationship between vehicle apparatuses and a platoon travel control system according to an exemplary embodiment of the present invention.

The above and other objects, features and advantages of the present invention will be more clearly understood from the following detailed description taken in conjunction with the accompanying drawings. In the specification, in adding reference numerals to components throughout the drawings, it is to be noted that like reference numerals designate like components even though components are shown in different drawings. Further, when it is determined that the detailed description of the known art related to the present invention may obscure the purpose of the present invention, the detailed description thereof will be omitted. In the description, the terms "first," "second," and so on are used to distinguish one element from another element, and the elements are not defined by the above terms.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, exemplary embodiments of the present invention will be described in detail with reference to the accompanying drawings.

FIG. 1 is an exemplary diagram illustrating a connection relationship between vehicle apparatuses and a platoon travel control system according to an exemplary embodiment of the present invention. As shown in FIG. 1, a plurality of vehicle apparatuses 100 and a platoon travel control system 200 may be configured to transmit and receive data related to travel in a platoon via a communication network Further, inter-vehicle communication may be performed among the plurality of vehicle apparatuses 100 so that a procedure such as a handover of control over the travel in a platoon may be performed.

According to an exemplary embodiment of the present invention, a vehicle apparatus 100 may be configured to calculate charges for platoon travel of surrounding vehicles based on charge calculation conditions input by a user, or may be configured to receive charges for platoon travel of the surrounding vehicles calculated from platoon travel control system 200, and a lead vehicle may be selected by checking charges for platoon travel matched with the surrounding vehicles.

Figure 2:
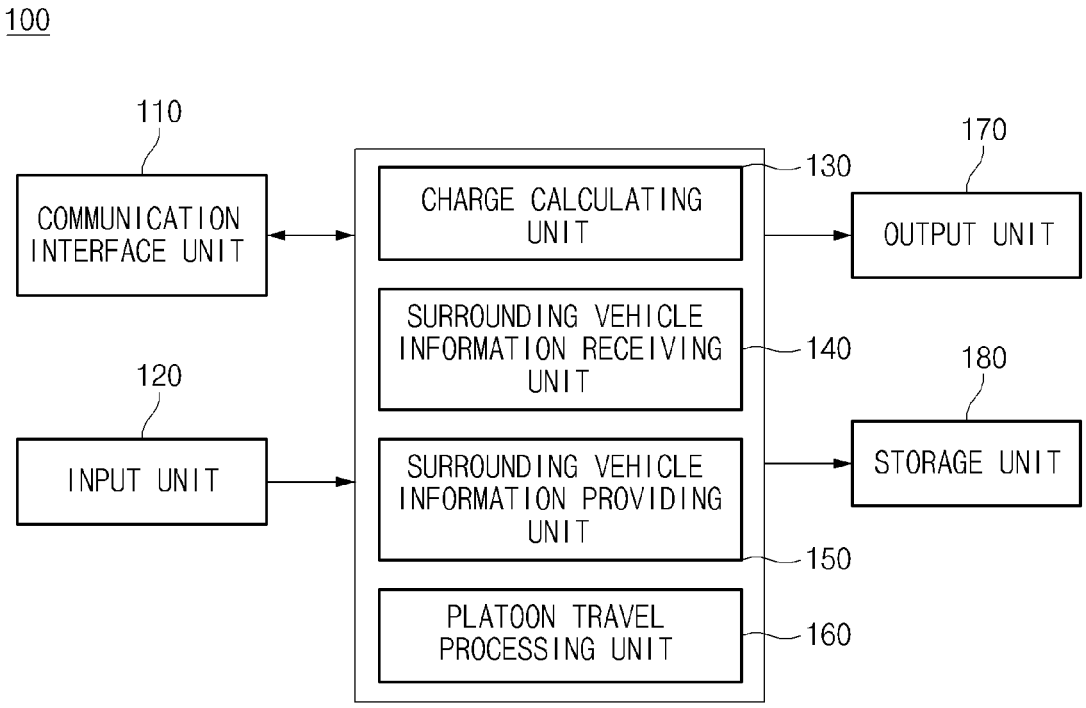
FIG. 2 is an exemplary block diagram illustrating a configuration of a vehicle apparatus according to an exemplary embodiment of the present invention.
Figure 3:
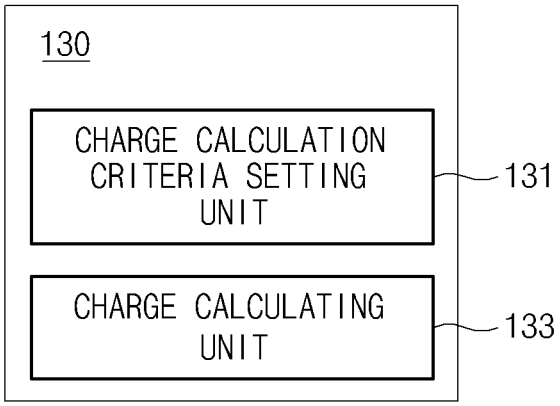
FIG. 3 is an exemplary block diagram illustrating a configuration of a charge calculating unit according to an exemplary embodiment of the present invention.

FIG. 2 is an exemplary block diagram illustrating a configuration of a vehicle apparatus according to an exemplary embodiment of the present invention, and FIG. 3 is an exemplary block diagram illustrating a configuration of a charge calculating unit according to an exemplary embodiment of the present invention. In this regard, an example for illustrating a method for controlling travel in a platoon shown in FIGS. 7 to 10 may be considered.

As shown in FIG. 2, a vehicle apparatus 100 may include a plurality of units executed by a controller. The plurality of units may include a communication interface unit 110, an input unit 120, a charge calculating unit 130, a surrounding vehicle information receiving unit 140, a surrounding vehicle information providing unit 150, a platoon travel processing unit 160, an output unit 170 and a storage unit 180.

Specifically, the surrounding vehicle information receiving unit 140 may be configured to receive images of the surrounding vehicles and information on the surrounding vehicles transmitted from the platoon travel control system 200. In particular, the information on the surrounding vehicles may be used to calculate charges for platoon travel and may be a value that corresponds to items of charge calculation conditions described below. Further, the images of the surrounding vehicles and the information on the surrounding vehicles may include identification information of the vehicle apparatuses to facilitate calculating charges for the platoon travel and matching the charges for the platoon travel with the images of the surrounding vehicles.

The charge calculating unit 130 may be configured to calculate the charges for platoon travel of the surrounding vehicles based on the charge calculation conditions input via the input unit 120 by a user, or may be configured to receive the charges for platoon travel of the surrounding vehicle transmitted from the platoon travel control system 200.

As indicated in Table 1 below, the charge calculation conditions may include one or more items and weights including a departure point, a destination, a stopover point, a minimum number of vehicles in platoon travel, a maximum number of vehicles in platoon travel, a travel time, a driving experience, an accident rate, a driver's age, driver's gender, a vehicle model, an engine displacement, a model year, charge designated by a lead vehicle, and recommendation points. However, the present invention is not limited thereto but additional conditions such as a priority may be added if needed by an operator.

TABLE 1

| Items | Remarks |
|---|---|
| 1. departure point | The closer to current point departure point is, + |
| 2. destination | The closer to user destination is, + |
| 3. stopover point | The less stopover point is, + |
| 4. a minimum number of vehicles in platoon travel | Designated according to driver's preference |
| 5. a maximum number of vehicles in platoon travel | Designated according to driver's preference |
| 6. driving time | The shorter driving time is, + |
| 7. driving experience | The longer experience is, + |
| 8. accident rate | The less accident rate is, + |
| 9. driver's age | Designated according to driver's preference |
| 10. driver's gender | Designated according to driver's preference |
| 11. vehicle model | Designated according to driver's preference |
| 12. engine displacement, model year | Designated according to driver's preference |
| 13. charges | The less charges are requested, + |
| 14. recommendation points | The more recommendation points from previous users, + |

As shown in FIG. 3, when the vehicle apparatus 100 calculates the charges the platoon travel, the charge calculating unit 130 may include a charge calculation criteria setting unit 131 configured to receive and manage the charge calculation condition input by a user, and charge calculation unit 133 configured to calculate the charges for the platoon travel of the surrounding vehicle using the information on the surrounding vehicle and the charge calculation conditions. In particular, the user a predetermined number of items of the charge calculation conditions (items 1 to 14 in Table 1); however, the present invention is not limited thereto but the user may select all of the items. In addition, the charge calculation conditions may include item selection and weights for items, e.g., 1 to 5 weights per item.

Alternatively, when the vehicle apparatus 100 receives the charge for the platoon travel from the platoon travel control system 200, the charge calculation criteria setting unit 131 may be configured to transmit the charge calculation conditions input by the user to the platoon travel control system 200. Further, the charge calculation unit 133 may be configured to receive the charges for the platoon travel of the surrounding vehicles transmitted from the platoon travel control system 200.

Figure 8:
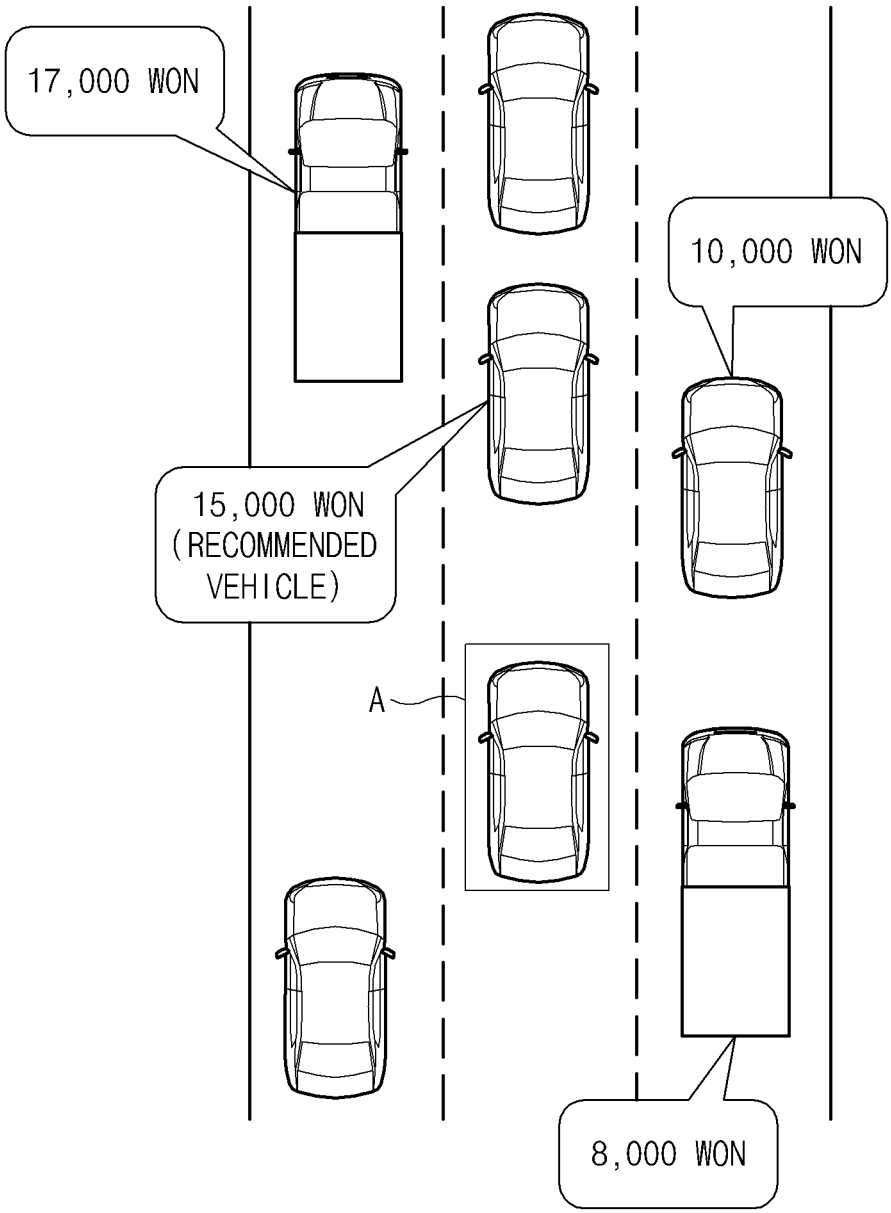

The surrounding vehicle information providing unit 150 may be configured to output the charges for platoon travel of the surrounding vehicles transmitted from the charge calculation unit 130 by matching with the images of the surrounding vehicles via output unit 170. For example, when a vehicle A in FIG. 7 attempts to travel in a platoon, the surrounding vehicle information providing unit 150 may be configured to output charges for the platoon travel of the surrounding vehicles with respect to A via output unit 170, as shown in FIG. 8.

Figure 9:
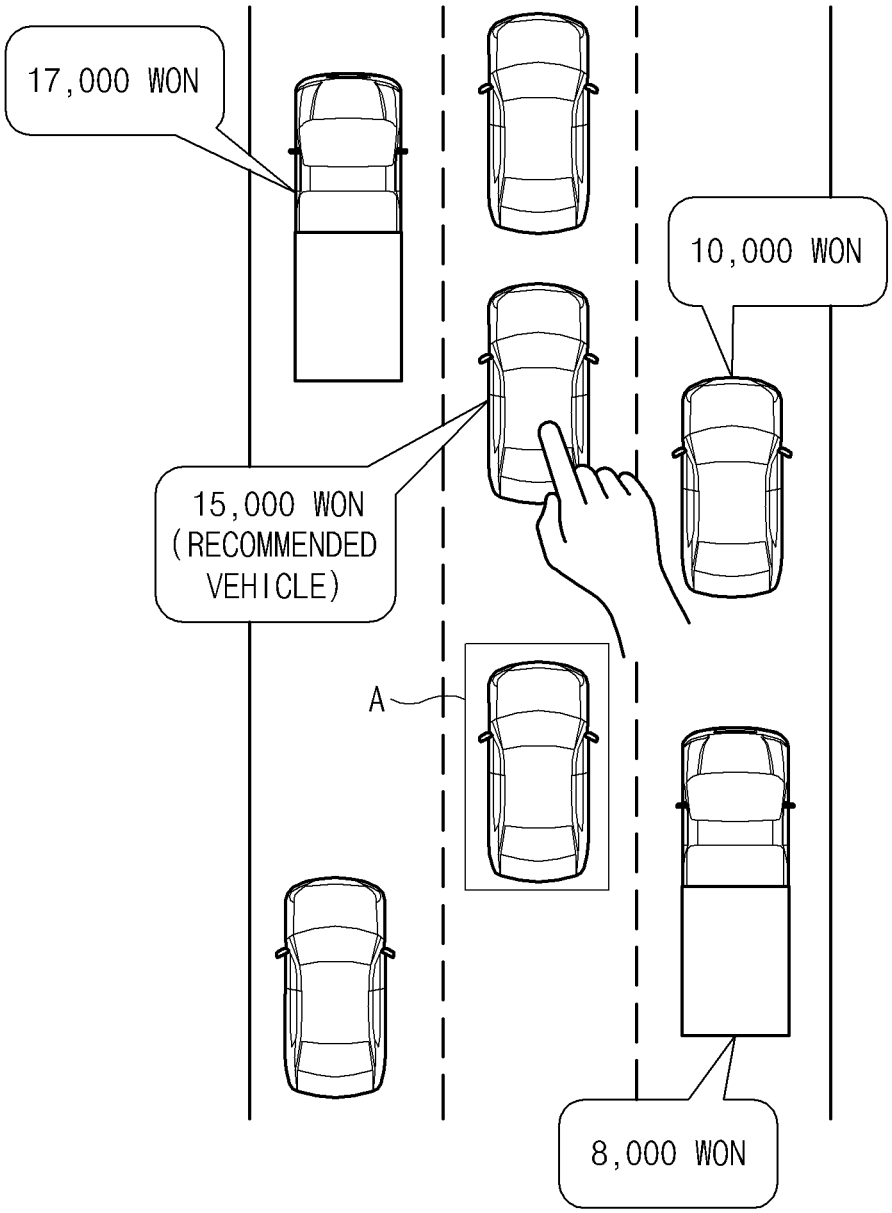
Figure 10:
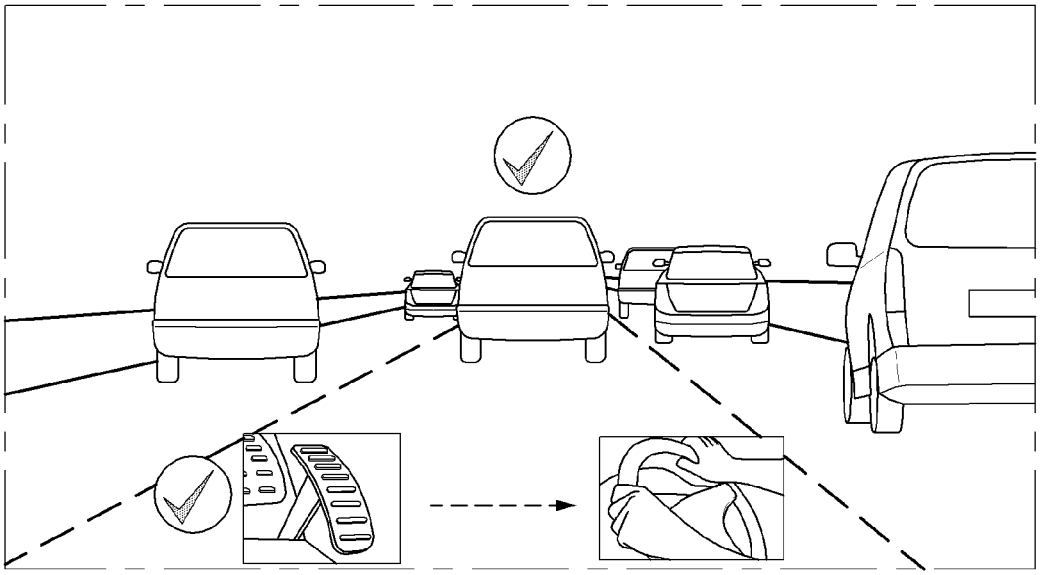

Further, as shown in FIG. 9, a user may select a vehicle from the plurality of vehicles which indicate the charge for the platoon travel via the output unit 170 to designate the selected vehicle as a lead vehicle. The platoon travel processing unit 160 may be configured to designate a particular vehicle selected by the user matched with the charges for the platoon travel as a lead vehicle, and may then be configured to perform a platoon travel procedure. For example, as shown in FIG. 10, the vehicle apparatus 100 may move to the same traffic lane as the vehicle designated as the lead vehicle, and may maintain a certain distance to the lead vehicle while preparing platoon travel. In response to receiving an approval signal from the lead vehicle, the platoon travel service may be initiated. Accordingly, the handover of control for platoon travel may be returned in the order of longitudinal direction control, i.e., acceleration/deceleration, and transverse direction control, i.e., steering control.

Figure 4:
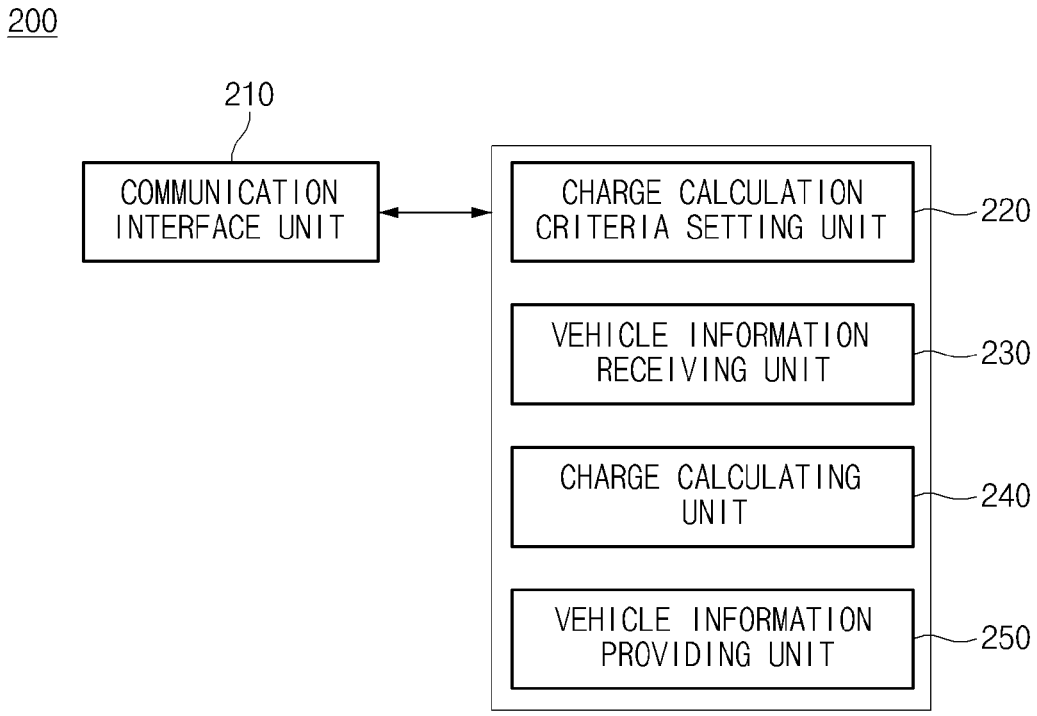
FIG. 4 is an exemplary block diagram illustrating a configuration of a platoon travel control system according to an exemplary embodiment of the present invention.

FIG. 4 is an exemplary block diagram illustrating a configuration of a platoon travel control system according to an exemplary embodiment of the present invention. As shown in FIG. 4, the platoon travel control system 200 may include a plurality of units executed by a controller. The plurality of units may include a communication interface unit 210, a charge calculation criteria setting unit 220, a vehicle information receiving unit 230, a charge calculation unit 240 and a vehicle information providing unit 250.

Specifically, the charge calculation criteria setting unit 220 may be input by a user, or may be configured to receive the charge calculation conditions transmitted from the vehicle apparatus 100 to manage the vehicle apparatus 100 by matching the charge calculation conditions with the identification information of the vehicle apparatus 100. In particular, the charge calculation conditions may include one or more items and weights including a departure point, a destination, a stopover point, a minimum number of vehicles in platoon travel, a travel time, a driving experience, an accident rate, a driver's age, driver's gender, a vehicle model, an engine displacement, a model year, charge designated by a lead vehicle, and recommendation points. However, the present invention is not limited thereto but additional conditions such as a priority may be added if needed by an operator.

The vehicle information receiving unit 230 may be configured to receive information to calculate the charges from the plurality of vehicle apparatuses 100, and may be configured to receive the images of the vehicle matched with the identification information of the vehicle apparatus 100 from a plurality of imaging devices (not shown). In particular, the imaging devices (not shown) may be installed throughout the roads to image travel information of vehicles, and may provide images around the vehicle apparatus 100 which has requested the platoon travel service based on the request received from the platoon travel control system 200. Specifically, the platoon travel control system 200 may be configured to locate the vehicle apparatus 100 which has requested the platoon travel service, and may be configured to send a request for the images of the surrounding vehicles to the imaging devices located at the corresponding position.

The charge calculation unit 240 may be configured to calculate charges for the platoon travel of the surrounding vehicles based on the predetermined charge calculation conditions of the vehicle apparatus 100 of which the charges for the platoon travel have been requested. In particular, since the charge calculation conditions are managed by matching the conditions with the identification information of the vehicle apparatus, the charge calculation unit 240 may be configured to extract the charge calculation conditions based on the identification information of the vehicle apparatus.

The vehicle information providing unit 250 may be configured to transmit the charges for platoon travel of the surrounding vehicles and the images of the surrounding vehicles with respect to the vehicle apparatus 100 of which the charges for platoon travel have been requested to the vehicle apparatus 100 which has requested the charges for platoon travel by matching the conditions with the identification information of the vehicle apparatus 100.

Figure 5:
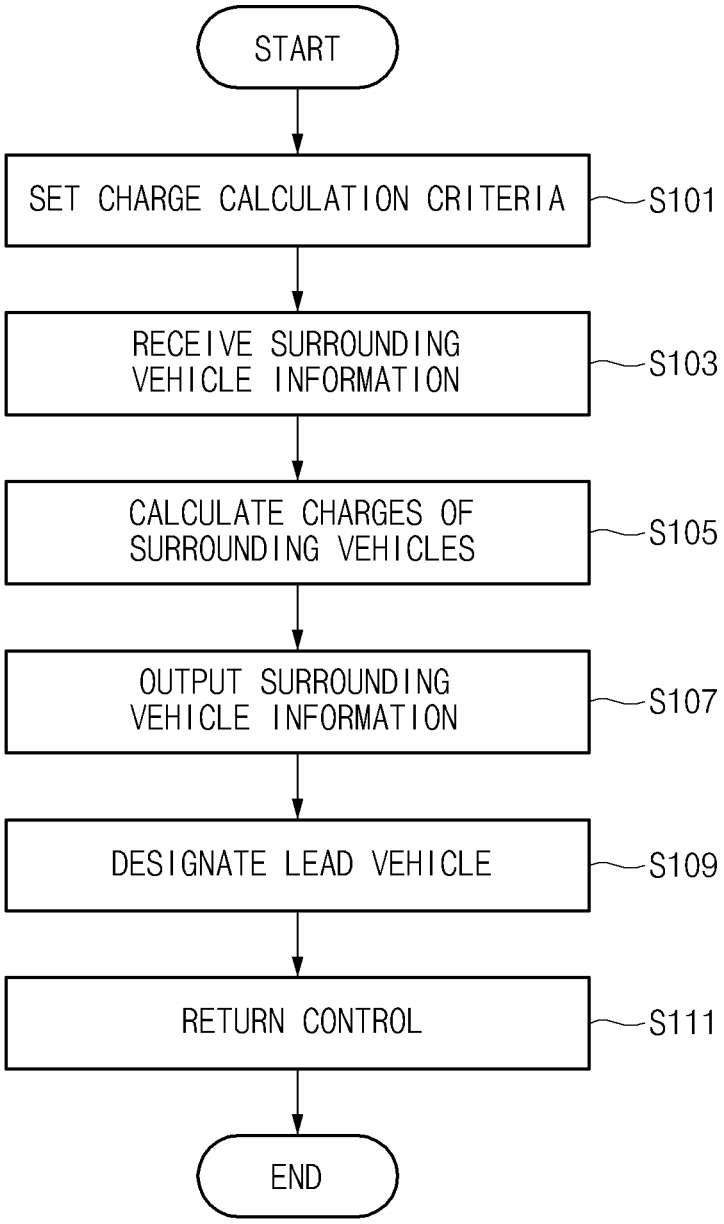
FIG. 5 is an exemplary flow chart illustrating a method for selecting a lead vehicle executed in a vehicle apparatus according to an exemplary embodiment of the present invention.

FIG. 5 is an exemplary flow chart for illustrating a method for selecting a lead vehicle executed in a vehicle apparatus according to an exemplary embodiment of the present invention. Specifically, the method may include receiving, by a vehicle apparatus 100, charge calculation conditions input via an input unit 120 by a user (S101). Here, the charge calculation conditions may include one or more items and weights including a departure point, a destination, a stopover point, a minimum number of vehicles in platoon travel, a travel time, a driving experience, an accident rate, a driver's age, driver's gender, a vehicle model, an engine displacement, a model year, charge designated by a lead vehicle, and recommendation points. However, the present invention is not limited thereto but additional conditions such as a priority may be added if needed by an operator.

Additionally, the method may include receiving, by the vehicle apparatus 100, the images of the surrounding vehicles and the information on the surrounding vehicles, which are matched with the identification information of the vehicle apparatus, transmitted from the platoon travel control system 200 (S103). Here, the information on the surrounding vehicles may be used to calculate charges for platoon travel and may be a value that corresponds to items of charge calculation conditions.

Then, the vehicle apparatus 100 may be configured to calculate the charges for the platoon travel of the surrounding vehicles based on the charge calculation conditions and the information on the surrounding vehicles (S105). Specifically, the charges may be calculating, by the vehicle apparatus 100, for platoon travel by applying the charge information predetermined according to the items and weights included in the charge calculation conditions.

Then, the vehicle apparatus 100 may be configured to output the charges for platoon travel of the surrounding vehicle via an output unit 170 by matching with the images of the surrounding vehicles (S107). In particular, the charges may be output, by the vehicle apparatus 100, for platoon travel in association with the images of the surrounding vehicles based on the identification information of the vehicle apparatus.

Then, the vehicle apparatus 100 may be configured to designate a particular vehicle selected by the user from among the surrounding vehicles matched with the charges for platoon travel as a lead vehicle (S109). Subsequently, the vehicle apparatus 100 may be configured to process the return of control via the communication with the vehicle apparatus designated as the lead vehicle (S111).

Figure 6:
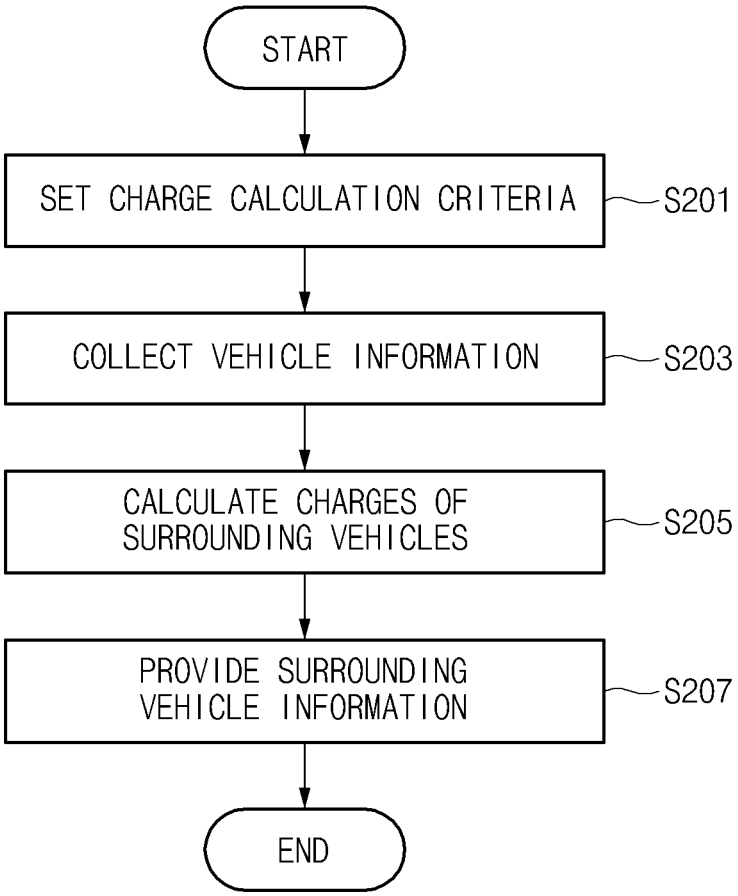
FIG. 6 is an exemplary flow chart illustrating a method for selecting a lead vehicle executed in a platoon travel control system according to an exemplary embodiment of the present invention.
Figure 7:
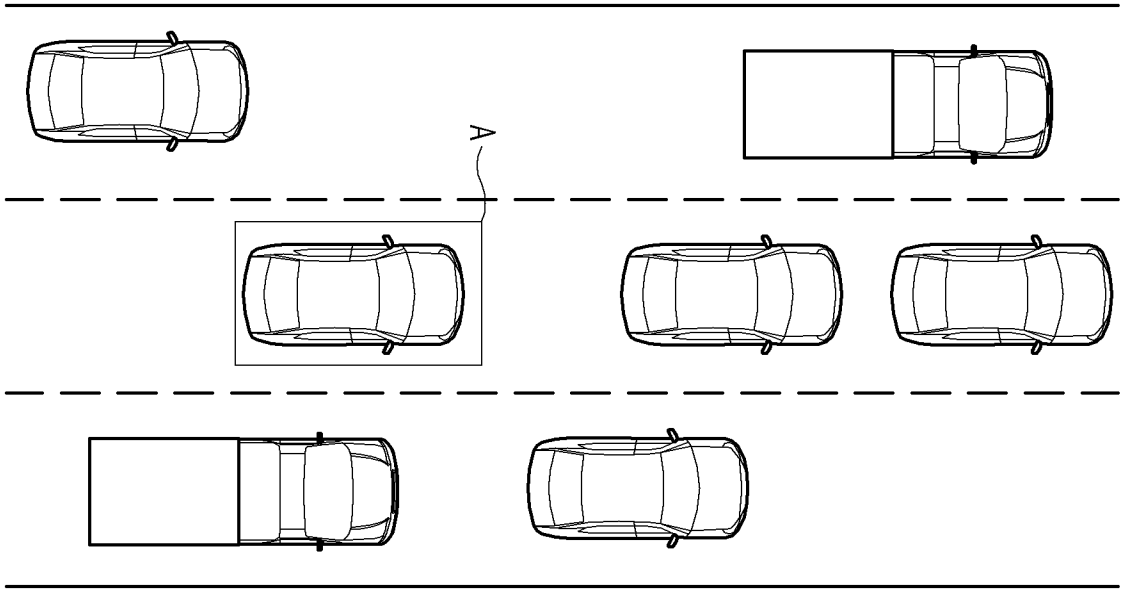
FIGS. 7 to 10 are exemplary diagrams showing illustrating a method for controlling travel in a platoon according to an exemplary embodiment of the present invention.

FIG. 6 is an exemplary flow chart for illustrating a method for selecting a lead vehicle executed in a platoon travel control system according to an exemplary embodiment of the present invention. The method may include receiving, by a controller, charge calculation conditions input by a user, or transmitted from a vehicle apparatus 100 and storing the conditions by matching with the identification information of the vehicle apparatus 100 (S201). In addition, the method may include, collecting, by the controller, the information for calculating charges transmitted from the plurality of the vehicle apparatuses, and the images of the vehicles matched with the identification information of the vehicle apparatuses transmitted from a plurality of imaging devices (not shown) (S203).

Next, the charges for platoon travel of the surrounding vehicles may be calculated based on the predetermined charge calculation condition of the vehicle apparatus of which the charges for the platoon travel is requested (S205). In particular, the controller may be configured to calculate the charges for platoon travel by applying the charge information predetermined according to the items and weights included in the charge calculation conditions. Then, the charges for platoon travel of the surrounding vehicles and the images of the surrounding vehicles with respect to the vehicle apparatus 100 of which the charges for the platoon travel have been requested may be transmitted to the vehicle apparatus 100 of which the charges for the platoon travel have been requested (S207).

The method for selecting a lead vehicle may be implemented in a form of program commands capable of being executed through various computer means to thereby be recordable in a computer-readable recording medium. In particular, the computer-readable recording medium may include a program command, a data file, a data structure or the like, alone or a combination thereof. Meanwhile, the program command recorded in the computer-readable recording medium may be especially designed and constituted for the present invention or be known to those skilled in a field of computer software.

Examples of the computer-readable recording medium may include a magnetic medium such as a hard disk, a floppy disk, or a magnetic tape; an optical recording medium such as a compact disk read only memory (CD-ROM), or a digital versatile disk (DVD); a magneto-optical medium such as a floptical disk; and a hardware device specially constituted to store and perform program commands, such as a ROM, a random access memory (RAM), a flash memory, or the like. Meanwhile, the computer readable medium may also be a transmission medium such as light including a carrier transmitting a signal specifying a program command, a data structure, or the like, a metal line, a waveguide, or the like.

In addition, examples of the program commands may include a high-level language code capable of being executed by a computer using an interpreter, or the like, as well as a machine language code made by a compiler. The above-mentioned hardware device may be constituted to be operated as at least one software module in order to perform an operation according to the present invention, and vice versa.

As stated above, according to a vehicle apparatus, platoon travel control system and a method for selecting a lead vehicle according to embodiments of the present invention, charges for platoon travel of surrounding vehicles may be calculated based on conditions set by a user and a lead vehicle may be selected based on the calculated charges, such that satisfaction for a user in platoon travel may be improved.

Further, according to exemplary embodiments of the present invention, a service method for platoon travel may be systematized In addition, according to exemplary embodiments of the present invention, in selecting a lead vehicle in platoon travel, various charging systems may be applied according to a user's preference.

Although the exemplary embodiment of the present invention has been disclosed for illustrative purposes, it will be appreciated that the present invention is not limited thereto, and those skilled in the art will appreciate that various modifications, additions and substitutions are possible, without departing from the scope and spirit of the invention.

Accordingly, any and all modifications, variations or equivalent arrangements should be considered to be within the scope of the invention, and the detailed scope of the invention will be disclosed by the accompanying claims.

What is claimed is:

1. A vehicle apparatus, comprising:

a controller configured to:

receive images of surrounding vehicles and information on the surrounding vehicles transmitted from a platoon travel control system;

calculate charges for platoon travel of the surrounding vehicles based on charge calculation conditions input, or receive charges for platoon travel of the surrounding vehicles transmitted from the platoon travel control system;

output the transmitted charges for platoon travel of the surrounding vehicles by matching the charges with the images of the surrounding vehicles; and execute a platoon travel procedure by designating a vehicle selected by a user from among the surrounding vehicles matched with the charges for platoon travel as a lead vehicle, wherein the platoon travel procedure is initiated in response to receiving an approval signal from the lead vehicle, and a handover of control for platoon travel of the vehicle apparatus is returned.

2. The apparatus according to claim 1, wherein when the vehicle apparatus calculates the charges for platoon travel, the controller is further configured to:

receive and manage the charge calculation conditions input by the user; and calculate the charges for platoon travel of the surrounding vehicle using the information on the surrounding vehicle and the charge calculation conditions.

3. The apparatus according to claim 1, wherein when the vehicle apparatus receives the charges for platoon travel from the platoon travel control system, the controller is further configured to:

transmit charge calculation conditions input by the user to the platoon travel control system; and receive the charges for platoon travel of the surrounding vehicle transmitted from the platoon travel control system.

4. The apparatus according to claim 1, wherein the charge calculation conditions include one or more items and weights selected from a group consisting of: a departure point, a destination, a stopover point, a minimum number of vehicles in platoon travel, a maximum number of vehicles in platoon travel, a travel time, a driving experience, an accident rate, a driver's age, driver's gender, a vehicle model, an engine displacement, a model year, a charge designated by a lead vehicle, and recommendation points.

5. A platoon travel control system, comprising:

a controller configured to:

receive charge calculation conditions input by a user or transmitted from a vehicle apparatus to manage the conditions by matching with identification information of the vehicle apparatus;

receive information for calculating charges from a plurality of vehicle apparatuses;

receive an image of the vehicle matched with the identification of the vehicle apparatus and images of surrounding vehicles from a plurality of imaging devices;

calculate charges for platoon travel for the surrounding vehicles based on predetermined charge calculation conditions of the vehicle apparatus of which the charges for platoon travel have been requested; and transmit the charges for platoon travel of the surrounding vehicles and the images of the surrounding vehicles with respect to the vehicle apparatus of which the charges for the platoon travel have been requested to the vehicle apparatus which has requested the charges for the platoon travel by matching the conditions with the identification information of the vehicle apparatus.

6. The system according to claim 5, wherein the charge calculation conditions include one or more items and weights selected from a group consisting of: a departure point, a destination, a stopover point, a minimum number of vehicles in platoon travel, a maximum number of vehicles in platoon travel, a travel time, a driving experience, an accident rate, a driver's age, driver's gender, a vehicle model, an engine displacement, a model year, a charge designated by a lead vehicle, and recommendation points.

7. A method for selecting a lead vehicle, comprising:

receiving, by a controller of a vehicle apparatus, charge calculation conditions via an input;

receiving, by the controller, images of surrounding vehicles and information on the surrounding vehicles matched with identification information of the vehicle apparatus transmitted from a platoon travel control system;

calculating, by the controller, charges for platoon travel of the surrounding vehicle based on the charge calculation condition and the information on the surrounding vehicles;

outputting, by the controller, the charges for platoon travel of the surrounding vehicles via an output by matching the images of the surrounding vehicles with the conditions; and designating, by the controller, a vehicle selected by a user from among the surrounding vehicles matched with the charges for platoon travel as a lead vehicle, wherein the lead vehicle is designated in response to receiving an approval signal from the lead vehicle, and a handover of control platoon travel of the vehicle apparatus is returned.

8. The method according to claim 7, wherein the charge calculation conditions include one or more items and weights selected from a group consisting of: a departure point, a destination, a stopover point, a minimum number of vehicles in platoon travel, a maximum number of vehicles in platoon travel, a travel time, a driving experience, an accident rate, a driver's age, driver's gender, a vehicle model, an engine displacement, a model year, charge designated by a lead vehicle, and recommendation points.

9. The method according to claim 7, wherein the outputting of the charges includes:

outputting, by the controller, the images of the surrounding vehicles based on the identification information matched with the charges for platoon travel of the surrounding vehicles.

10. A method for selecting a lead vehicle, comprising:

receiving, by a platoon travel control system, charge calculation conditions input by a user or transmitted from a vehicle apparatus;

storing, by the platoon travel control system, the charge calculation conditions by matching the conditions with identification information of the vehicle apparatus;

collecting, by the platoon travel control system, information for calculating charges transmitted from a plurality of vehicles and images of the vehicles matched with identification information of the vehicle transmitted from a plurality of imaging devices;

calculating, by the platoon travel control system, charges for platoon travel of surrounding vehicles based on predetermined charge calculation conditions of a vehicle apparatus of which charges for platoon travel has been requested;

transmitting, by the platoon travel control system, charges for platoon travel of the surrounding vehicles and images of the surrounding vehicles with respect to the vehicle apparatus of which charges for platoon travel has been requested by matching with identification information of the vehicle to a vehicle apparatus which has requested charges for platoon travel;

receiving and outputting, by the vehicle apparatus, the charges for platoon travel of the surrounding vehicles and images of the surrounding vehicles transmitted from the platoon travel control system; and designating, by the vehicle apparatus, a vehicle selected by a user from among the surrounding vehicles matched with the charges for platoon travel as a lead vehicle.

11. A non-transitory computer readable medium containing program instructions executed by a processor or controller, the computer readable medium comprising:

program instructions that receive charge calculation conditions via an input;

program instructions that receive images of surrounding vehicles and information on the surrounding vehicles matched with identification information of a vehicle apparatus transmitted from a platoon travel control system;

program instructions that calculate charges for platoon travel of the surrounding vehicle based on the charge calculation condition and the information on the surrounding vehicles;

program instructions that output the charges for platoon travel of the surrounding vehicles via an output by matching the images of the surrounding vehicles with the conditions; and program instructions that designate a vehicle selected by a user from among the surrounding vehicles matched with the charges for platoon travel as a lead vehicle, wherein the lead vehicle is designated in response to receiving an approval signal from the lead vehicle, and a handover of control for platoon travel of the vehicle apparatus is returned.

12. The non-transitory computer readable medium of claim 11, wherein the charge calculation conditions include one or more items and weights selected from a group consisting of: a departure point, a destination, a stopover point, a minimum number of vehicles in platoon travel, a maximum number of vehicles in platoon travel, a travel time, a driving experience, an accident rate, a driver's age, driver's gender, a vehicle model, an engine displacement, a model year, charge designated by a lead vehicle, and recommendation points.

13. The non-transitory computer readable medium of claim 11, further comprising:

program instructions that output the images of the surrounding vehicles based on the identification information matched with the charges for platoon travel of the surrounding vehicles.

14. A non-transitory computer readable medium containing program instructions executed by a processor or controller, the computer readable medium comprising:

program instructions that receive charge calculation conditions input by a user or transmitted from a vehicle apparatus;

program instructions that store the charge calculation conditions by matching the conditions with identification information of the vehicle apparatus;

program instructions that collect information for calculating charges transmitted from a plurality of vehicles and images of the vehicles matched with identification information of the vehicle transmitted from a plurality of imaging devices;

program instructions that calculate charges for platoon travel of surrounding vehicles based on predetermined charge calculation conditions of a vehicle apparatus of which charges for platoon travel has been requested; and program instructions that transmit charges for platoon travel of the surrounding vehicles and images of the surrounding vehicles with respect to the vehicle apparatus of which charges for platoon travel has been requested by matching with identification information of the vehicle to a vehicle apparatus which has requested charges for platoon travel.

* * * * *